US011617465B2

(12) United States Patent
Zhang et al.

(10) Patent No.: US 11,617,465 B2
(45) Date of Patent: Apr. 4, 2023

(54) ARTICLE STORAGE AND RETRIEVAL APPARATUS

(71) Applicant: BEIJING JINGDONG ZHENSHI INFORMATION TECHNOLOGY CO., LTD., Beijing (CN)

(72) Inventors: Yafang Zhang, Beijing (CN); Jun Xiao, Beijing (CN); Hui Wang, Beijing (CN); Zongjing Yu, Beijing (CN); Jian Zhang, Beijing (CN)

(73) Assignee: BEIJING JINGDONG ZHENSHI INFORMATION TECHNOLOGY CO., LTD., Beijing (CN)

( * ) Notice: Subject to any disclaimer, the term of this patent is extended or adjusted under 35 U.S.C. 154(b) by 62 days.

(21) Appl. No.: 17/261,724

(22) PCT Filed: Jul. 29, 2019

(86) PCT No.: PCT/CN2019/098191
§ 371 (c)(1),
(2) Date: Jan. 20, 2021

(87) PCT Pub. No.: WO2020/024905
PCT Pub. Date: Feb. 6, 2020

(65) Prior Publication Data

US 2021/0228013 A1 Jul. 29, 2021

(30) Foreign Application Priority Data

Aug. 3, 2018 (CN) ..... 201810877365.0

(51) Int. Cl.
*A47G 29/14* (2006.01)
*A47G 29/20* (2006.01)

(52) U.S. Cl.
CPC ..... *A47G 29/141* (2013.01); *A47G 29/20* (2013.01); *A47G 2029/146* (2013.01)

(58) Field of Classification Search
CPC ..... A47G 29/141; A47G 29/20; A47G 29/00; A47G 29/12; A47G 29/122; A47G 29/14;
(Continued)

(56) References Cited

U.S. PATENT DOCUMENTS 922,181 A * 5/1909 Ohlson ..... A47G 29/12095 232/38
923,903 A * 6/1909 Silverstein ..... A47G 29/1201 232/23

(Continued)

FOREIGN PATENT DOCUMENTS

CN 206400692 U * 8/2017
CN 107708501 A * 2/2018 ..... A47G 29/14
CN 207618171 U * 7/2018

*Primary Examiner* — William L Miller
(74) *Attorney, Agent, or Firm* — Oblon, McClelland, Maier & Neustadt, L.L.P.

(57) ABSTRACT

The present disclosure relates to an article storage and retrieval apparatus, including a frame body, configured to be fixed on a vertical mounting surface; a cap body, the cap body, hinged with the frame body at upper end, left end or right end to rotate to open and close; and an accommodating box, arranged in a space formed between the frame body and the cap body, adopting a foldable structure and configured to be unfolded alter the cap body is opened relative to the frame body to form a space for accommodating articles and allow the cap body to be closed relative to the frame body after being folded.

16 Claims, 2 Drawing Sheets

Figure 1:
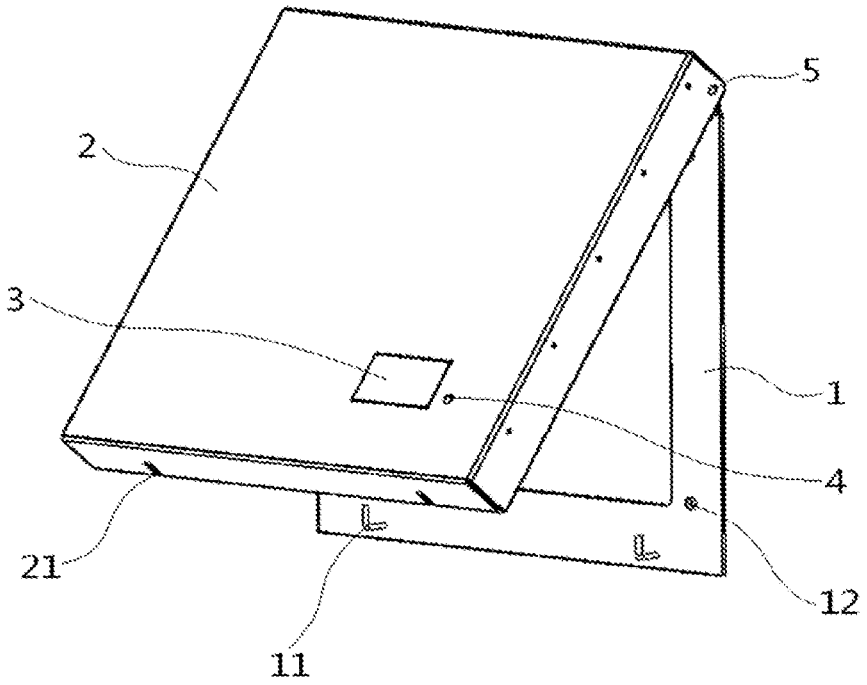

(58) Field of Classification Search
CPC ..... A47G 29/16; A47G 2029/144; A47G 2029/145; A47G 2029/146; A47G 2029/148; A47G 2029/149; B65D 7/26; B65D 7/24; B65D 21/086; B65D 11/186; B65D 11/184; B65D 11/1853; B65D 9/14; B65D 15/24; E05B 65/0075
USPC ..... 232/19, 38, 45, 1 E; 220/6, 666; 340/569; 70/63
See application file for complete search history.

(56) References Cited

U.S. PATENT DOCUMENTS 1,673,769 A * 6/1928 Graham ..... G07C 13/02 220/6
2,456,479 A * 12/1948 Antil ..... B65D 9/14 312/258
6,426,699 B1 * 7/2002 Porter ..... A47F 10/00 340/568.1
10,321,780 B1 * 6/2019 James ..... A47G 29/141
10,537,196 B1 * 1/2020 MacPherson ..... A47G 29/141
10,696,453 B2 * 6/2020 Sena ..... A47G 29/141
10,709,276 B2 * 7/2020 Guanch ..... A47G 29/20
10,743,694 B2 * 8/2020 Raphael ..... A47G 29/20
10,743,695 B1 * 8/2020 Altmaier ..... B60R 9/065
11,109,705 B2 * 9/2021 Raphael ..... A47G 29/141
11,197,566 B2 * 12/2021 Aresu ..... A47G 29/124
11,246,443 B2 * 2/2022 Lin ..... A47G 29/141
11,278,144 B2 * 3/2022 Vernal Silva ..... A47G 29/20
11,311,132 B2 * 4/2022 Eivaz ..... A47G 29/141
2013/0284733 A1 * 10/2013 Samprathi ..... B65D 11/1873 220/7
2017/0286905 A1 * 10/2017 Richardson ..... G06Q 10/0832
2018/0070753 A1 * 3/2018 Eveloff ..... H04W 4/025
2018/0296016 A1 * 10/2018 Teoh ..... A47G 29/20
2019/0225375 A1 * 7/2019 Sena ..... A47G 29/20
2019/0320836 A1 * 10/2019 Guanch ..... A47G 29/20
2019/0350398 A1 * 11/2019 Raphael ..... A47G 29/20
2020/0107663 A1 * 4/2020 Eivaz ..... A47G 29/141
2020/0352376 A1 * 11/2020 Vernal Silva ..... A47G 29/1218
2021/0127880 A1 * 5/2021 Raphael ..... A47G 29/20

* cited by examiner

ARTICLE STORAGE AND RETRIEVAL APPARATUS

CROSS-REFERENCE TO RELATED APPLICATION

The present application is a National Stage of International Application No. PCT/CN2019/098191 fled on Jul. 29, 2019, which claims priority to Chinese Patent Application No. 201810877365.0, entitled "ARTICLE STORAGE AND RETRIEVAL APPARATUS" and filed on Aug. 3, 2018, both of which are incorporated herein by reference in their entireties.

FIELD OF THE DISCLOSURE

The present disclosure relates to an article storage and retrieval apparatus.

BACKGROUND OF THE DISCLOSURE

With the rise of online shopping and logistics industry, the number of express delivery orders has increased rapidly year by year. People need to wait for the courier at home when receiving and sending a package, and the door-to-door time of the courier cannot be accurately controlled at present, which inevitably coincides with the time when the customer is not at home. When the customer is not at home, the courier has to come again at another time, or deliver the package to the neighbors for collection, directly place it at the door or small shops nearby and other methods and the like with safety risk.

For the courier, when there is no one in the customer's home, it will consume a lot of time cost and reduce efficiency by changing the delivery time; however, there are safety risks such as package loss by changing the collection way.

For the customer, it is difficulty to ensure that there is someone at home when the courier arrives. When the customer needs to go out, it is a very bad shopping experience to worry about when the courier will come to the door, reconfirm the door-to-door time with the courier and whether the package will be lost in the storage place.

SUMMARY OF THE DISCLOSURE

The embodiment of the present disclosure provides an article storage and retrieval apparatus, including:

a frame body, configured to be fixed on a vertical mounting surface;

a cap body, hinged with the frame body at upper end, left end or right end to rotate to open and close; and an accommodating box, arranged in a space formed between the frame body and the cap body, adopting a foldable structure and configured to be unfolded after the cap body is opened relative to the frame body to form a space for accommodating articles and allow the cap body to be closed relative to the frame body after being folded.

In some embodiments, the article storage and retrieval apparatus further includes:

a locking component, configured to realize a locked state of the article storage and retrieval apparatus; and an identity recognition component, configured to unlock the first locking component after identity verification information provided by a user is verified successfully.

In some embodiments, the locking component includes:

a first locking component, arranged between the cap body and the frame body for locking after the cap body is closed relative to the frame body; and a second locking component, arranged between the accommodating box and the cap body or the frame body for locking the accommodating box after the accommodating box is unfolded.

In some embodiments, the first locking component and the second locking component have a common locking portion.

In some embodiments, the first locking component includes: a lock groove formed in one of the cap body and the frame body, and a lock hook, a lock rod or a lock tongue arranged on the other one of the cap body and the frame body; or the first locking component includes: a lock catch, a lock hook or a lock rod arranged on the cap body and the frame body respectively and cooperating with each other.

In some embodiments, the second locking component includes: a lock groove formed in one of the cap body and the accommodating box, and a lock hook, a lock rod or a lock tongue arranged on the other one of the cap body and the accommodating box; or the second locking component includes: a lock catch, a lock hook or a lock rod arranged on the cap body and the accommodating box respectively and cooperating with each other.

In some embodiments, the first locking component includes a lock hook arranged on the frame body, the accommodating box is provided with a hole, and a free end of the lock hook is inserted into the hole to fix the accommodating box when the accommodating box is unfolded.

In some embodiments, the frame body is of a plate-shaped structure, a cavity is formed in the cap body, and the accommodating box is stored in the cavity after being folded.

In some embodiments, the accommodating box abuts against the frame body after being unfolded.

In some embodiments, the accommodating box includes:

two first plates, arranged oppositely, and a first end of each of the two first plates being connected to one of the cap body and the frame body;

a second plate, located between the two first plates and connected to a second end, away from the first ends, of each of the two first plates; and a third plate, a first end of the third plate being connected to an end part, except the first plates, of the second plate, and a second end of the third plate being able to turn over relative to the second plate to unfold or fold the accommodating box;

wherein each of the first plates is provided with a folding line extending parallel to the second plate at a middle position vertical to the second plate, and a connection position of the adjacent plates is also provided with the folding line.

In some embodiments, a second locking component is arranged between the third plate and the cap body or the accommodating box for locking the accommodating box after the accommodating box is unfolded.

In some embodiments, two first plates are arranged vertical to a plane where the frame body is located, and end parts, close to the frame body, of the two first plates are attached to the frame body, so that the accommodating box abuts against the frame body after being unfolded.

In some embodiments, a delivery opening is formed between the accommodating box and the cap body or between the third plate and the frame body when the accommodating box is unfolded, to allow articles to enter when the accommodating box is locked; or the accommodating box is provided with a delivery opening.

In some embodiments, a limiting plate is arranged at two ends, adjacent to the first plates, of the third plate, and the limiting plate is configured to cover outer sides of the first plates after the accommodating box is unfolded.

In some embodiments, an extending plate is arranged on end parts, adjacent to the third plate, of the first plates, the limiting plate is provided with an opening, and when the accommodating box is unfolded, the limiting plate covers the outer sides of the first plates and the extending plate is inserted into the opening.

In some embodiments, the article storage and retrieval apparatus is an express box.

BRIEF DESCRIPTION OF THE ACCOMPANYING DRAWINGS

Figure 2:
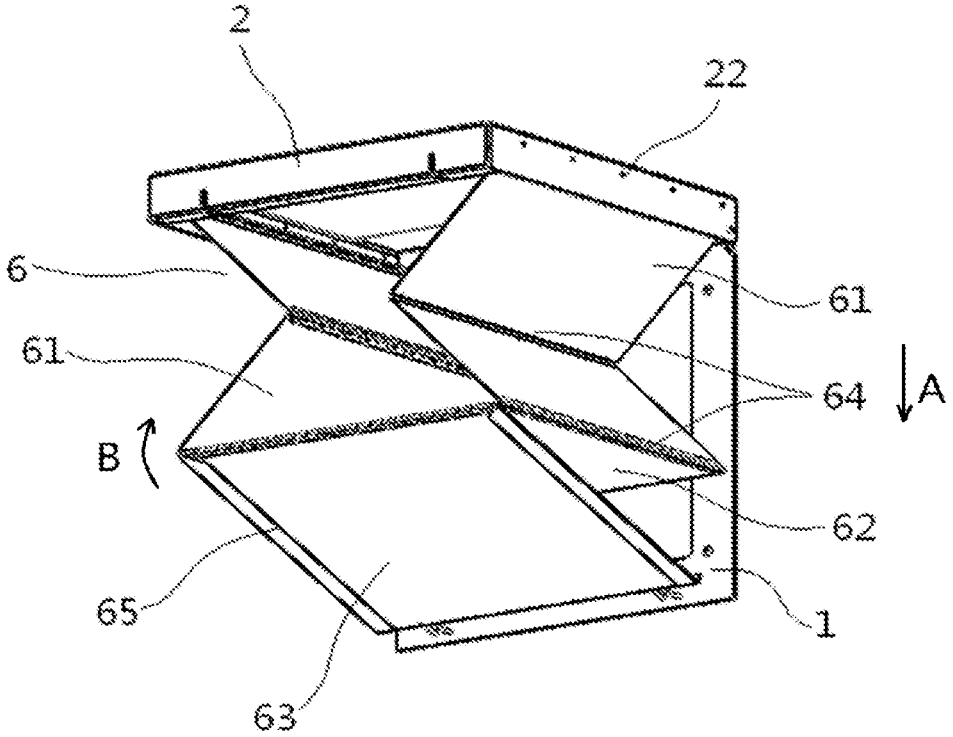
Figure 3:
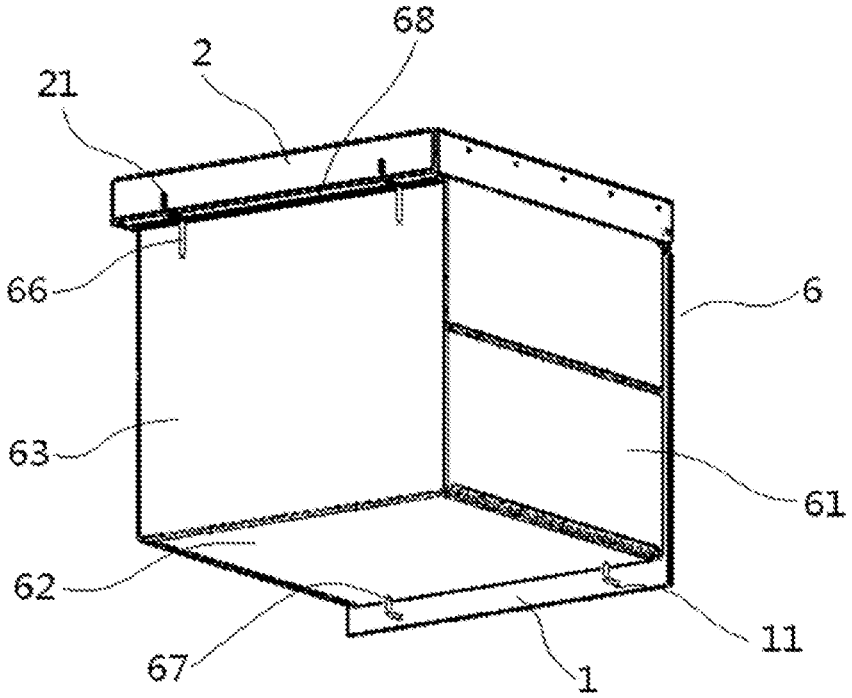

The accompanying drawings described herein are used to provide further understanding of the present disclosure and constitute a part of the present application. The schematic embodiments of the present disclosure and the description thereof are used to explain the present disclosure, but do not constitute an inappropriate limitation to the present disclosure. In the accompanying drawings:

FIG. 1 is a schematic diagram of some embodiments of an article storage and retrieval apparatus according to the present disclosure when a cap body is in an unlocked state;

FIG. 2 is a state schematic diagram of some embodiments of a container in an article storage and retrieval apparatus according to the present disclosure in the unfolding process of an accommodating box; and FIG. 3 is a state schematic diagram of some embodiments of an article storage and retrieval apparatus according to the present disclosure when an accommodating box is unfolded and a cap body is locked.

DETAILED DESCRIPTION OF THE PREFERRED EMBODIMENTS

The present disclosure is described hereinafter in detail. In the following paragraphs, different aspects of embodiments are defined in detail. The aspects defined may be combined with one or more of any other aspects unless it is explicitly pointed that they cannot be combined. In particular, any features considered to be preferred or favorable may be combined with one or more of other features considered to be preferred or combination favorable.

The terms "first", "second" and the like appearing in the present disclosure are only used to facilitate description so as to distinguish different components with the same name, but not to represent a sequence or a primary and secondary relationship.

In the description of the present disclosure, it should be understood that an azimuth or position relationship indicated by terms "upper", "lower", "top", "bottom", "front", "rear", "inner" and "outer" and the like is an azimuth or position relationship based on the accompanying draws, which is only for convenient description of the present disclosure, but not indicates or implies that the referred device must have a specific azimuth and perform construction and operation in the specific azimuth; therefore, it cannot be interpreted as a limitation to the protection scope of the present disclosure. In the following description, one side, facing the mounting surface, of the article storage and retrieval apparatus is defined as the rear, and other directions are defined based on this.

The embodiment of the present disclosure provides an article storage and retrieval apparatus, which can improve the article storage and retrieval convenience.

Based on the above technical solutions, the article storage and retrieval apparatus according to some embodiments of the present disclosure is arranged at a position where a user can take and place articles conveniently. The device is unfolded to form a space for accommodating articles after the cap body is opened relative to the frame body and allows the cap body to be closed relative to the frame body after being folded. By adoption of the article storage and retrieval apparatus, articles may be stored and taken more conveniently and waiting time may be saved; moreover, the foldable accommodating box is provided, so that the article storage and retrieval apparatus may be folded when not being used, occupied space may be reduced and the overall structure is simple.

As shown in FIG. 1 to FIG. 3, the present disclosure provides an article storage and retrieval apparatus. In some embodiments, the article storage and retrieval apparatus includes a frame body 1, a cap body 2 and an accommodating box 6.

The frame body 1 is configured to be fixed on a vertical mounting surface. The vertical mounting surface mentioned here includes a vertical surface at 90° with a horizontal surface, and a mounting surface with a preset range of angle deviation from the vertical surface. For example, the article storage and retrieval apparatus may be fixed at a position convenient for a specific user to take and place articles. For home users, the mounting surface may be arranged near the user's house, corridor or entrance. For company users, the mounting surface may be arranged near the door of the company.

The cap body 2 and the frame body 1 are hinged at upper end, let end or right end to realize rotary opening and closing. The accommodating box 6 is arranged in a space formed between the frame body 1 and the cap body 2, adopts a foldable structure and is configured to be unfolded after the cap body 2 is opened relative to the frame body 1 to form a space for accommodating articles; and the accommodating box 6 is folded after the articles are taken out so as to allow the cap body 2 to be closed relative to the frame body 1.

To realize the foldable structure of the accommodating box 6, each composition plate of the accommodating box 6 may adopt a metal material or hard plastic, etc., or even if a soft material is adopted, a hard supporting framework is arranged at the periphery of the plate, thus facilitating folding.

The article storage and retrieval apparatus according to the embodiment of the present disclosure at least has one of the following advantages:

the articles can be stored and taken more conveniently, the deliverer and the picker are connected more smoothly, use is facilitated, waiting time may be saved, and the article storage and retrieval efficiency is improved.

The accommodating box adopts a foldable structure, and can form a space for accommodating the articles ater being unfolded and can be folded after the articles are taken out. By the structure, the occupied volume of the article storage and retrieval apparatus in a non-use state may be minimized, and the folded accommodating box may maintain a certain shape, so that the cap body 2 can be closed relative to the frame body 1 easily.

The cap body 2 and the frame body 1 are hinged at the upper end, left end or right end to realize rotary opening and closing, and the cap body 2 is controllably opened under the action of an external force under the condition that the user applies a force after the article storage and retrieval apparatus is unlocked, so that the cap body cannot be freely unfolded under the action of the gravity, thus improving the stability when the article storage and retrieval apparatus is opened, reducing the impact of the accommodating box 6 when being unfolded and prolonging the service life of the article storage and retrieval apparatus.

In some embodiments, the article storage and retrieval apparatus is an express box, correspondingly, the article is an express. The express box may be used by specific users and related couriers and the accommodating box 6 is unfolded after the cap body 2 is opened relative to the frame body 1 to form a space for accommodating articles, so that it is convenient for a deliverer to put the express in the accommodating box 6; and the accommodating box is folded after a picker takes out the express to close the cap body 2 relative to the frame body 1, thus reducing the occupied space of the express box in a non-use state.

Compared with the shared express cabinet, the express box is simple in structure and small in volume, may flexibly adapt to the needs of the user for sending and receiving express and online shopping, and is more convenient for the user to receive and send the express, thereby improving the convenience for the deliverer or the picker to store and take the express. In different usage scenarios, the deliverer and the picker correspond to one role of the courier and the user respectively.

The article storage and retrieval apparatus may be used by the courier for delivery and by the user for retrieving the express, so that when the delivery time of the courier and the receiving time of the user cannot be matched with each other, the delivery time may be saved, the delivery efficiency may be improved, and the safety of temporary express storage is improved; moreover, the article storage and retrieval apparatus may be used by the user for sending articles or returning and changing goods and the user does not need to wait for the courier to pick up goods at home, thus improving the experience of the user when sending express and returning or changing goods. The structure not only can meet the express storage and retrieval requirement when in use, but also can reduce the occupied space when not in use in a normal state, and has a simple structure.

In some embodiments, the article storage and retrieval device further includes a locking component and an identity recognition component. The locking component is configured to lock the article storage and retrieval apparatus and has locked and unlocked states. In the case where there is no need to put articles or articles have been put in, the article storage and retrieval apparatus should be in a locked state so as to ensure that the article storage and retrieval apparatus is not used by unrelated persons and ensure the article storage safety.

The identity recognition component is configured to unlock the locking component after identity verification information provided by a user (for example: a deliverer or a picker) is verified successfully. By the structure, the universality of the article storage and retrieval apparatus can be improved, the article storage and retrieval apparatus is easily popularized and used in different occasions, and the articles may be stored and taken intelligently.

In some embodiments, referring to FIG. 1 and FIG. 3, the locking component includes a first locking component and a second locking component. The first locking component is arranged between the cap body 2 and the frame body 1 for locking after the accommodating box 6 is folded and the cap body 2 is closed relative to the frame body 1. The second locking component is arranged between the accommodating box 6 and the cap body 2 or between the accommodating box 6 and the frame body 1, for locking the accommodating box 6 after the cap body 2 is opened relative to the frame body 1 and the accommodating box 6 is unfolded. After the accommodating box 6 is unfolded, a movable part of the accommodating box 6 may be fixed to the cap body 2 or the frame body 1 nearby.

According to the embodiment, the article storage and retrieval apparatus can be locked in a non-use state to ensure that the article storage and retrieval apparatus is not used by unrelated persons, and the article storage and retrieval apparatus can be locked in a state of accommodating articles to ensure the article storage safety.

In some embodiments, as shown in FIG. 3, the first locking component and the second locking component have a common locking portion. In some embodiments, the first locking component and the second locking component may adopt a common identity recognition component for unlocking. By the structure, the structure of the locking component may be simplified and the occupied space of the locking component in the article storage and retrieval apparatus is reduced, thus further realizing miniaturization of the article storage and retrieval apparatus. Alternatively, the first locking component and the second locking component may be structurally independent from each other.

The structures of the first locking component and the second locking component are not limited and are within the protection scope of the present disclosure as long as the first locking component and the second locking component can be locked and unlocked after the identity verification information is verified successfully. The locking component may be unlocked by an electromagnetic or electric driving actuator.

In some embodiments, the first locking component may include: a lock groove 21 formed in one of the cap body 2 and the frame body 1, and a lock hook 1, a lock rod 66 or a lock tongue, etc. arranged on the other one of the cap body 2 and the frame body 1 and cooperating with the lock groove 21. Or the first locking component may include: a lock catch, a lock hook 11 or a lock rod 66, etc. arranged on the cap body 2 and the frame body 1 respectively and cooperating with each other.

In some embodiments, the second locking component may include: a lock groove 21 formed in one of the cap body 2 and the accommodating box 6, and a lock hook 11, a lock rod 66 or a lock tongue, etc, arranged on the other one of the cap body 2 and the accommodating box 6 and cooperating with the lock groove 21. Or the second locking component may include: a lock catch, a lock hook 11 or a lock rod 66, etc. arranged on the cap body 2 and the accommodating box 6 respectively and cooperating with each other.

Specifically, as shown in FIG. 1, the first locking component includes a lock groove 21 formed in the cap body 2 and a lock hook 11 arranged on the frame body 1. As shown in FIG. 2, the second locking component includes a lock groove 21 formed in the cap body 2 and a lock hook 66 arranged on the accommodating box 6. To improve the locking firmness, a lock groove 21 may be formed at each of two ends of an opening and closing side of the cap body 2.

In some embodiments, the accommodating box 6 is provided with a hole 67, and when the accommodating box 6 is unfolded, a free end of the lock hook 11 is inserted into the hole 67 to fix the accommodating box 6 and provide bottom support for the accommodating box 6. As shown in FIG. 3, the lock hook 11 is an L-shaped lock hook, a transverse portion of the L-shaped lock hook is fixed on the frame body 1, and a free end of a vertical portion is inserted into the hole 67. The structure of the embodiment can assist in fixing the accommodating box 6, thus further improving stability and firmness after the article is placed in the accommodating box 6.

In some embodiments, the frame body 1 is of a plate-shaped structure, a cavity is formed in one side, facing the frame body 1, of the cap body 2, and the accommodating box 6 is stored in the cavity after being folded. The frame body 1 with the plate-shaped structure fixed on a mounting surface more easily, for example, the frame body 1 is fixed on the mounting surface by a fastener 12, or in an adhesion manner. Alternatively, the cap body 2 may also be designed into a plate-shaped structure, a cavity is formed in the frame body 1, and the accommodating box 6 is stored in the cavity of the frame body 1 after being folded.

The identity recognition component mentioned in the above embodiment may adopt various structure forms, for example, identity verification may be conducted through code scanning, face recognition, sound recognition, fingerprint recognition, verification code check and the like, and the electronic locking component is unlocked after identity is verified successfully. Or remote control unlocking may be conducted on a mobile terminal APP through a wifi module and/or a Bluetooth module. To achieve an identity recognition function, as shown in FIG. 1, a touch screen 3 and a camera 4 may be arranged on a front side of the cap body 2, the touch screen 3 may display information or receive identity recognition of the user, etc., and the camera 4 may provide face recognition. For the structure that the cavity is formed in the cap body 2, a structure relevant to the identity recognition component may be arranged on the cap body 2, and a space in the cavity may be completely utilized.

Still referring to FIG. 1, the first end of the cap body 2 is hinged to the frame body 1 and the second end of the cap body 2 is opened and closed relative to the frame body 1 through rotation. For example, a hinge part 5 is arranged between the first end of the cap body 2 and the frame body 1. The cap body 2 and the frame body 1 may be hinged at upper end, left end or right end to realize rotary opening and closing. The cap body 2 is opened and closed by the hinge structure, so that the stability when the cap body 2 is opened can be improved and the structure is simple.

Optionally, the cap body 2 and the frame body 1 may be of a rectangular structure, and the hinged end of the cap body 2 and the frame body 1 may be an upper end, left end or right end of the cap body 2. As shown in FIG. 1, the cap body 2 is hinged to an upper end of the frame body 1, so that the cap body 2 may be turned upwards. A foldable accommodating box 6 is hidden in the cap body 2.

In some embodiments, as shown in FIG. 3, the accommodating box 6 abuts against the frame body 1 after being unfolded, so that a supporting force is provided to the accommodating box 6 through the frame body 1, and the stability and position retaining capability after the accommodating box 6 accommodates articles are improved.

In a specific embodiment, as shown in FIG. 2, the accommodating box 6 includes: two first plates 61, a second plate 62 and a third plate 63. The two first plates 61 are arranged oppositely, and a first end of each of the two first plates 61 is connected to the cap body 2, for example, the first ends of the first plates 61 are connected to a wall surface of the cap body 2 through a connecting piece 22 such as a rivet or a hinge, etc. The second plate 62 is located between the two first plates 61 and is connected to a second end, away from the first end, of each of the two first plates 61. A first end of the third plate 63 is connected to an end part, except the first plates 61, of the second plate 62, and a second end of the third plate 63 may be turned over relative to the second plate 62 to unfold or fold the accommodating box 6. Since a back part of the accommodating box 6 is blocked by the frame body 1, the third plate 63 is arranged on a front part of the accommodating box 6.

Each of the first plates 61 is provided with a folding line 64 extending parallel to the second plate 62 at a middle position vertical to the second plate 62, and a connection position of the adjacent plates is also provided with the folding line 64. For example, the folding lines 64 are arranged at the connection position of the third plate 63 and the second plate 62 and the connection position of the second plate 62 and each of the two first plates 61. In order to prolong the service life of the accommodating box 6 and avoid damage after repeated folding, a hinge may be arranged at each folding line 64 for strengthening.

The accommodating box 6 of the embodiment is easy to fold, and the plates are stuck together after the accommodating box is folded, so that the occupied volume is small, and miniaturization of the article storage and retrieval apparatus may be realized maximally.

In some embodiments, as shown in FIG. 3, the two first plates 61 are arranged vertical to the frame body 1, and the end parts, close to the frame body 1, of the two first plates 61 are attached to the frame body 1, so that the accommodating box 6 abuts against the frame body 1 after being unfolded, a supporting force is provided to the accommodating box 6 through the frame body 1, and the accommodating box 6 is stably supported.

In some embodiments, as shown in FIG. 3, a locking component is arranged between the third plate 63 and the cap body 2. For example, a lock groove 21 is formed in a front side wall of the cap body 2 after the cap body 2 is opened, and a lock rod 66 is arranged at the free end of the third plate 63 of the accommodating box 6, so that locking is realized through cooperation of the lock rod 66 and the lock groove 21.

In some embodiments, as shown in FIG. 3, a delivery opening 68 is formed between the third plate 63 and the cap body 2 or between the third plate 63 and the frame body 1 when the accommodating box 6 is unfolded, to allow small articles such as express and the like to enter when the accommodating box 6 is locked. In the structure shown in FIG. 3, a height of the third plate 63 is less than that of the first plate 61, and a long strip-shaped delivery opening is formed between the third plate 63 and the cap body 2, so that envelopes or soft package expresses may be put in when the accommodating box is 6 locked. In other embodiments, a delivery opening 68 may be formed in a main body surface of each plate on the accommodating box 6.

In some embodiments, as shown in FIG. 2, a limiting plate 65 is arranged at two ends, adjacent to the first plates 61, of the third plate 63, and the limiting plate 65 can cover outer sides of the first plates 61 after the accommodating box 6 is unfolded. The limiting plate 65 may be arranged vertical to the third plate 63, for example, a limiting plate 65 with an overall structure may be arranged on each of the two ends, adjacent to the first plates 61, of the third plate 63, or a plurality of limiting plates 65 are arranged at each end at intervals.

According to the embodiment, by the limiting plate 65, a middle part of a side plate (such as a first plate 61) of the accommodating box 6 may be prevented from being opened outwards at a folded part, thus improving the firmness of the overall structure of the accommodating box 6, avoiding damage to the accommodating box 6 and ensuring the article storage safety.

In some embodiments, an extending plate is arranged on end parts, adjacent to the third plate 63, of the first plates 61, the limiting plate 65 is provided with an opening, and when the accommodating box 6 is unfolded, the limiting plate 65 covers the outer sides of the first plates 61 and the extending plate is inserted into the opening. The limiting plate 65 and the extending plate form an intersected structure and may form bidirectional fixation, so that the overall structure strength of the accommodating box 6 can be further improved.

In other embodiments, the first plates 61 may be connected to the frame body 1. In addition, for the embodiment shown in FIG. 2 where the first plates 61 are connected to the left end and right end of the cap body 2, the two first plates 61 may also be connected to the front end and back end of the cap body 2 respectively, correspondingly, the third plates 63 are arranged on the left side and right side.

By taking the case where the courier needs to deliver the express and the user takes out the express as an example, the use method of the article storage and retrieval apparatus with the structure, as an express box, is described below with reference to FIG. 1 to FIG. 3.

(1) The courier unlocks the article storage and retrieval apparatus:

when the courier, as a deliverer, needs to put the express in the article storage and retrieval apparatus, a third-party platform such as e-commerce or express and the like will match the article storage and retrieval apparatus according to the order information of the current express and open the authority for the courier to open the article storage and retrieval apparatus, for example, the third-party platform will transmit a verification code, a graphic code and the like for opening the article storage and retrieval apparatus to the courier, or may bind personal identity information (such as fingerprint, face, sound and the like) of the courier with the verification information of the article storage and retrieval apparatus, so that the courier may unlock the first locking component between the cap body 2 and the frame body 1 through identity verification, and the lock hook 11 is released and separated from the lock groove 21.

(2) The courier opens the article storage and retrieval apparatus and puts the express into the device:

The courier turns the cap body 2 upwards until the cap body 2 is in a horizontal state. As shown in FIG. 2, in the opening process of the cap body 2, each plate in the accommodating box 6 in a folded state before falls and is unfolded under the action of self weight and applies a downward action force to the first plate 61 or the second plate 62 until the second plate 62 falls to the lowest position, so that the first plate 61 forms a flat plate state. At this time, the accommodating box 6 is unfolded to form an article storage space, and the courier puts the express into the accommodating box 6. Then, the free end of the third plate 63 is turned upwards along an arrowhead B, and the lock rod 66 on the third plate 63 is inserted into the lock groove 21, so that the accommodating box 6 is locked.

When the accommodating box 6 is unfolded, since the cap body 2 has been in a horizontal state, a back side plate of the cap body 2 abuts against the mounting surface and cannot be turned upwards continuously. Furthermore, the back part of the accommodating box 6 is attached to the frame body 1 and abuts against the frame body 1 to resist a moment when the accommodating box 6 is turned downwards under the action of gravity, so that the accommodating box 6 is fixed stably. In some embodiments, the lock hook 11 at the bottom may be inserted into the hole 67 of the third plate 63 so as to assist in fixing the accommodating box 6.

(3) The user unlocks the article storage and retrieval apparatus:

1. The identity verification information of the user may be acquired by the following ways: The user who has performed identity information association with the article storage and retrieval apparatus may directly own the identity verification information of the article storage and retrieval apparatus, for example, preset password for opening the article storage and retrieval apparatus, entered fingerprint, face or sound information.

2. If the express needs to be taken by someone else, the courier may transmit a package retrieval code to the mobile terminal of the user after putting the express, and the user who has known the package retrieval code may unlock the article storage and retrieval apparatus by verifying the package retrieval code.

3. If the express needs to be taken by someone else, the courier may transmit information that the express has been stored to the third-party platform through the mobile terminal after putting the express, the third-party platform may transmit a package retrieval code to the mobile terminal of the user, and the user who has known the package retrieval code may unlock the article storage and retrieval apparatus by verifying the package retrieval code.

After the article storage and retrieval apparatus is unlocked, the lock rod 66 is removed from the lock groove 21.

(4) The user opens the article storage and retrieval apparatus and takes out the express:

The user turns the third plate 63 of the accommodating box 6 downwards to take out the express. The second plate 62 is pushed upwards, so that the folding lines 64 of the two first plates 61 are close to each other; meanwhile, the third plate 63 is turned to be attached to an outer surface of the second plate 62, so that each plate is attached to each other and is overally pressed into the cavity of the cap body 2. Then, the cap body 2 is turned downwards to be buckled with the frame body 1, and the lock hook 11 and the lock groove 21 are locked to return to a closed state.

Similarly, the article storage and retrieval apparatus according to the present disclosure may be applied to the situation that the courier needs to pick up the goods when the user sends or turns and changes goods. different from the above usage scenario, when the user needs to put the express, the user who has performed identity information association with the article storage and retrieval apparatus may directly own the identity verification information of the article storage and retrieval apparatus and may tell the identity verification information to others if asking others to take the express.

Then, after the user stores the express, the user needs to inform the third-party platform that goods need to be sent or returned and hopes the courier to pick up the goods at home, and the third-party platform will arrange a suitable courier to pick up the goods and transmit the identity verification information to the courier who is going to take the goods, so that the arrangement flexibility of the package retrieval business can be improved; or if the user has a familiar courier, the user may directly transmit the package retrieval code to the courier.

Secondly, the present disclosure further provides a working method of the article storage and retrieval apparatus based on the above embodiments. In one exemplary embodiment, the working method includes the following steps:

the identity recognition component verifies identity verification information provided by a deliverer or a picker; and after the information is verified successfully, the locking component is unlocked to change the unfolded or folded state of the accommodating box 6.

In some specific embodiments, the working method of the present disclosure includes:

an identity recognition component verifies identity verification information by a deliverer;

after the information is verified successfully, the locking component is unlocked, so that the deliverer unfolds the accommodating box 6 to put the express;

then, the identity recognition component verifies the identity verification information provided by the deliverer;

after the information is verified successfully, the locking component is unlocked, so that the picker folds the accommodating box 6 after retrieving the express.

For the previous embodiment, when the courier needs to deliver the express and the user needs to take the express, identity verification information provided by the courier as a deliverer is from the third-party platform, the third-party platform matches the article storage and retrieval apparatus according to the information of the express to be delivered and gives the authority to the corresponding courier to open the article storage and retrieval apparatus and store the express. The identity verification information provided by the user as a picker is from: the identity verification information which is set to perform identity association with the article storage and retrieval apparatus in advance, the courier transmits the package retrieval code to the user after putting the express, or the courier transmits the information that the express has been stored to the third-party platform and the third-party platform transmits the package retrieval code to the user.

When the user needs to send the express and the courier needs to take the express, the identity verification information provided by the user as a deliverer is from the verification information which is set to perform identity association with the article storage and retrieval apparatus in advance. The identity verification information provided by the courier as a picker is from: the user directly transmits the package retrieval code to the courier, or the user informs the third-party platform after storing the express and the third-party platform gives the authority to the corresponding courier to open the article storage and retrieval apparatus and take the express.

The article storage and retrieval apparatus according to the present disclosure is introduced above in detail. The principle and embodiments of the present disclosure are elaborated by specific embodiments, and the description of the above embodiments is only intended to help understand the method of the present disclosure and the core concept thereof. It should be noted that those skilled in the art may also make several improvements and modifications without departing from the principles of the present disclosure which should fall within the protection scope of the claims of the present disclosure.

What is claimed is:

1. An article storage and retrieval apparatus, comprising:

a frame body, configured to be fixed on a vertical mounting surface;

a cap body, hinged with the frame body at upper end, left end or right end to rotate to open and close; and an accommodating box, arranged in a space formed between the frame body and the cap body, adopting a foldable structure and configured to be unfolded after the cap body is opened relative to the frame body to form a space for accommodating articles, and allow the cap body to be closed relative to the frame body after being folded;

wherein the accommodating box comprises:

two first plates, arranged oppositely, and a first end of each of the two first plates being connected to one of the cap body and the frame body;

a second plate, located between the two first plates and connected to a second end, away from the first end, of each of the two first plates; and a third plate, a first end of the third plate being connected to an end part of the second plate which is not connected with the first plate, and a second end of the third plate being able to turn over relative to the second plate to unfold or fold the accommodating box.

2. The article storage and retrieval apparatus according to claim 1, further comprising:

a locking component, configured to realize a locked state of the article storage and retrieval apparatus; and an identity recognition component, configured to unlock the locking component after identity verification information provided by a user is verified successfully.

3. The article storage and retrieval apparatus according to claim 2, wherein the locking component comprises:

a first locking component, arranged between the cap body and the frame body to lock after the cap body is closed relative to the frame body; and a second locking component, arranged between the accommodating box and the cap body or the frame body to lock the accommodating box after the accommodating box is unfolded.

4. The article storage and retrieval apparatus according to claim 3, wherein the first locking component and the second locking component have a common locking portion.

5. The article storage and retrieval apparatus according to claim 3, wherein the first locking component comprises: a lock groove formed in one of the cap body and the frame body, and a lock hook, a lock rod or a lock tongue arranged on the other of the cap body and the frame body; or the first locking component comprises: a lock catch, a lock hook or a lock rod arranged on the cap body and the frame body respectively and cooperating with each other.

6. The article storage and retrieval apparatus according to claim 3, wherein the second locking component comprises: a lock groove formed in one of the cap body and the accommodating box, and a lock hook, a lock rod or a lock tongue arranged on the other one of the cap body and the accommodating box and cooperating with the lock groove; or the second locking component comprises: a lock catch, a lock hook or a lock rod arranged on the cap body and the accommodating box respectively and cooperating with each other.

7. The article storage and retrieval apparatus according to claim 3, wherein the first locking component comprises a lock hook arranged on the frame body, the accommodating box is provided with a hole, and a free end of the lock hook is inserted into the hole to fix the accommodating box when the accommodating box is unfolded.

8. The article storage and retrieval apparatus according to claim 1, wherein the frame body is of a plate-shaped structure, a cavity is formed in the cap body, and the accommodating box is stored in the cavity after being folded.

9. The article storage and retrieval apparatus according to claim 1, wherein the accommodating box abuts against the frame body after being unfolded.

10. The article storage and retrieval apparatus according to claim 1, wherein each of the first plates is provided with a folding line extending parallel to the second plate at a middle position vertical to the second plate, and a connection position of the adjacent plates is also provided with the folding line.

11. The article storage and retrieval apparatus according to claim 10, wherein a second locking component is arranged between the third plate and the cap body or the accommodating box for locking the accommodating box after the accommodating box is unfolded.

12. The article storage and retrieval apparatus according to claim 10, wherein the two first plates are arranged vertical to a plane where the frame body is located, and end parts, close to the frame body, of the two first plates are attached to the frame body, so that the accommodating box abuts against the frame body after being unfolded.

13. The article storage and retrieval apparatus according to claim 10, wherein a delivery opening is formed between the third plate and the cap body or between the third plate and the frame body when the accommodating box is unfolded, to allow articles to enter when the accommodating box is locked; or the accommodating box is provided with a delivery opening.

14. The article storage and retrieval apparatus according to claim 10, wherein two ends, adjacent to the first plate, of the third plate are respectively provided with a limiting plate, and the limiting plate is configured to cover outer sides of the first plates after the accommodating box is unfolded.

15. The article storage and retrieval apparatus according to claim 14, wherein an end, adjacent to the third plate, of the first plate is provided with an extension plate, the limiting plate is provided with an opening, and when the accommodating box is unfolded, the limiting plate covers the outer sides of the first plates and the extending plate is inserted into the opening.

16. The article storage and retrieval apparatus according to claim 1, wherein the accommodating box is an express box.

* * * * *